United States Patent [19]

Ralls

[11] Patent Number: 4,720,884

[45] Date of Patent: Jan. 26, 1988

[54] CLEANING PIG WITH DEBRIS FLUSHING ACTION

[75] Inventor: Gene R. Ralls, Tulsa, Okla.

[73] Assignee: T. D. Williamson, Inc., Tulsa, Okla.

[21] Appl. No.: 9,143

[22] Filed: Jan. 29, 1987

[51] Int. Cl.[4] ..... B08B 9/04

[52] U.S. Cl. ..... 15/104.061

[58] Field of Search ..... 15/104.06 R, 104.06 A, 15/3.5, 3.51; 137/268

[56] References Cited

U.S. PATENT DOCUMENTS 4,122,575 10/1978 Sagawa ..... 15/104.06 R

*Primary Examiner*—Edward L. Roberts

*Attorney, Agent, or Firm*—Head & Johnson

[57] ABSTRACT

A cleaning pig for use in a pipeline to be moved through the pipeline by the flow of fluid therethrough, the pig being formed of a cylindrical body having shallow depth channels formed in paralleled spiral patterns on the cylindrical surface, and an elongated, narrow, brush member positioned in each of the channels, each of the brush members having bristles which extend generally radially outward from the pig body, the width of the brush members being less than the width of the channels providing fluid flow passageways within each of the channels permitting fluid to flow past the pig as it is moved through a pipeline to thereby flush debris which has been brushed from the pipeline sidewall forwardly of the pig so that the debris will be carried out of the pipeline.

9 Claims, 3 Drawing Figures

CLEANING PIG WITH DEBRIS FLUSHING ACTION

SUMMARY OF THE INVENTION

Pipelines employed for moving fluids whether liquids or gases, tend to become incrusted on their interior surfaces. This can be caused by oxidation if the pipeline is made of metal, or by the depositions of solids from the fluids passing through the pipeline. As solids adhere to the interior wall of a pipeline the maximum fluid carrying potential of the pipeline is decreased. For this reason it is important to clean the interior of pipelines and for this purpose the use of cleaning pigs is a standard technique.

The typical cleaning pig is a device which fits within the interior of a pipeline and is moved by fluid flow through the line. Apparatus is provided on the pig to engage the interior wall of the pipeline to scrape or brush the interior so as to dislodge solid materials which have adhered to the pipeline interior wall. For information related to the use of pipeline pigs which have means for brushing or scraping the internal wall of the pipeline as they pass therethrough, reference may be had to the following U.S. Pat. Nos: 3,204,274; 3,879,790; 3,538,531; 3,605,159; 3,389,417; and 3,474,479.

The present invention is an improvement in the concept of a cleaning pig made of a cylindrical body having wire brushs thereon. In the present invention the pig cylindrical body is provided with a series of spaced apart shallow depth channels arranged in a spiral format. Positioned in each of the shallow depth channels is an elongated narrow brush member or strap, which is typically formed of a flexible backing with metal bristles extending upwardly therefrom. The narrow brush members are affixed to the pig body within the channels such as by adhesive bonding. The improvement in this invention lies in the relationship between the width of each channel and the width of the brush member received within it. The brush member is dimensioned to be of a width less than the width of the channel permitting a fluid flow passageway between the channel sidewall and the brush member. In the preferred embodiment, the brush member is centrally positioned within the channel so that a fluid flow passageway is provided to either side of the brush member.

With this arrangement spiraled fluid flow passageways are provided on the exterior cylindrical surface of the pig body. These flow passageways permit fluid to flow past the pig as the pig is moved by the fluid flow through the pipeline. In other words, the cleaning pig moves through the pipeline at a velocity less than the fluid flow velocity. Debris which is scraped from the pipeline sidewall by the pig tends to be moved by the fluid flow past the pig to thereby move the debris in advance of the cleaning pig. This insures that at least a substantial portion of the debris dislodged from the pipeline interior wall by the cleaning pig is flushed out of the pipeline rather than permitting the dislodged debris to merely accumulate within the pipeline.

A better understanding of the invention will be had by reference to the following description and claims, taken in conjunction with the attached drawings.

DESCRIPTION OF THE PREFERRED EMBODIMENT

Figure 1:
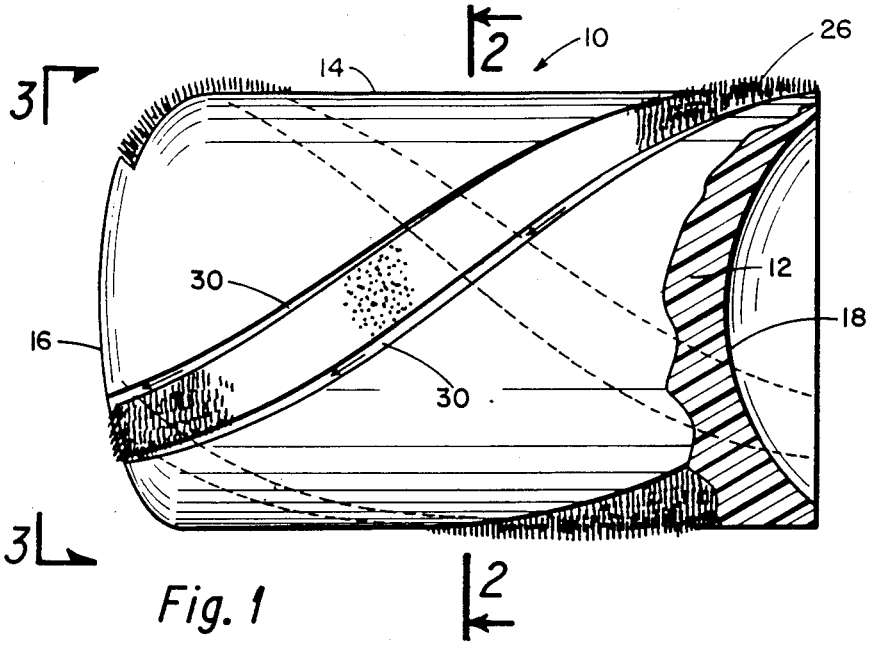
FIG. 1 is an elevational view, shown partially in cross-section, of an embodiment of the cleaning pig of this invention.
Figure 2:
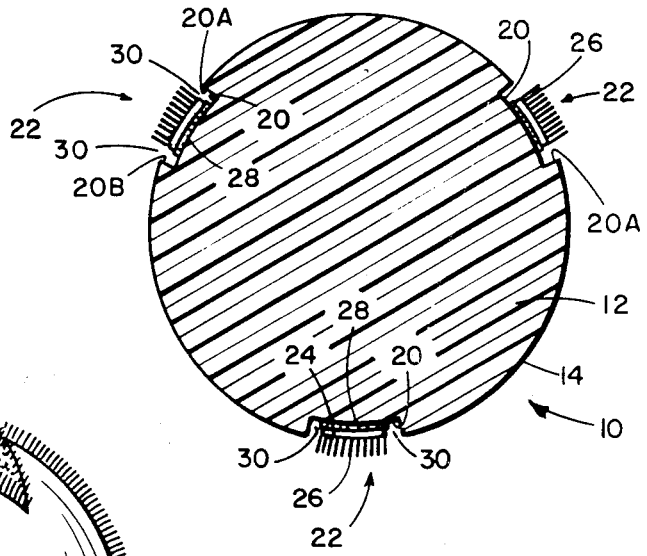
FIG. 2 is a cross-sectional view taken along the lines 2—2 of FIG. 1.

Referring to the drawings, and first to FIG. 1, a cleaning pig which includes the principles of this invention is shown in elevational side view. The cleaning pig is generally indicated by the numeral 10 and is formed by a cylindrical body 12 having an external cylindrical surface 14, a forward end 16 and a rearward end 18. The body 12 is preferably formed of a semi-rigid material such as polyurethane foam material. The rearward end 18 is concave to augment the forward force applied by fluid flowing through a pipeline in which the cleaning pig is used. The forward end 16, is convex, or rounded, or pointed, so as to faciliate the movement of the pig through the pipeline and past openings or obstructions in the pipeline.

Formed on the cylindrical surface 14 are a plurality of shallow depth channels 20, three such channels being shown in the illustrated embodiment. The channels are spiral in configuration and spaced apart from each other. The channels are spiraled to a degree such that each channel covers a segment of the cylindrical surface which is greater than 360° divided by the number of channels. This means that with three channels employed as illustrated, each of the channels 20 traverses a segment of more than 120° of the cleaning pig exterior cylindrical surface 14. This insures that as the pig moves through a pipeline the entire cylindricl surface of the pipeline will be cleaned.

Positioned within each of the channels 20 is a brush member generally indicated by the numeral 22. Each brush member 22 is formed of a flexible backing 24 having bristles 26 extending generally radially outwardly from the flexible backing. The brush members 22 are in the form of elongated strips of uniform width and the brush members are secured within channels 20 such as by epoxy bonding 28.

Figure 3:
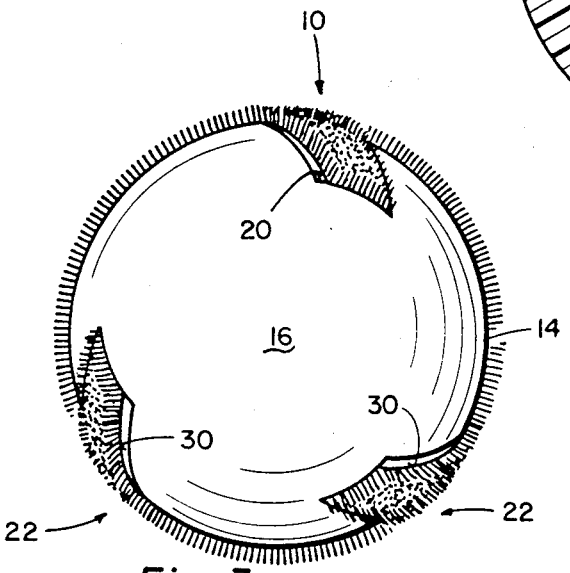
FIG. 3 is a view of the forward end of the cleaning pig of FIG. 1.

The bristles 26 of each brush member are of a height to extend radially outwardly above the body cylindrical surface 14 so that as the cleaning pig is moved through a pipeline the bristles 26 engage the pipeline around the entire internal circumference thereof to brush away solids which have adhered to the pipeline wall. As seen in FIG. 3, the channels 20 extend forwardly towards the forward end 16 in the area wherein the external diameter of the pig body has decreased so that the possibility of the pig body being lodged against a protrusion extending into the interior of a pipeline is reduced.

One of the problems associated with cleaning the interior of a pipeline by the use of a pig moved by fluid flow is that of flushing the dislodged debris from the interior of the pipeline. For this purpose, in the present arrangement, each channel 20 is of a width which is greater than the width of the brush member 22 received in the channel. This provides a spiraled fluid flow passageway 30 between the brush member 22 and the sidewall of the channel. The channel sidewalls are indicated by the numerals 20A and 20B. In the preferred and the illustrated embodiment, the brush members 22 are centrally positioned in the channels between the opposed side walls 20A and 20B thereby providing two fluid flow passageways for each channel. It can be seen that another embodiment which is not illustrated, the brush members 22 could be positioned contiguous to one of the sidewalls 20A or 20B, leaving a single fluid flow passageway in each channel.

As the cleaning pig 10 moves through the pipeline by the force of fluid flow the passageway 30 permit a portion of the fluid to flow past the pig as indicated by the arrows in FIG. 1. The fluid flow within passageways 30 tends to move any debris which has been dislodged by bristles 26 forwardly of the pig body as it moves through the pipeline. This flushing action thereby tends to carry the dislodged debris in advance of the cleaning pig and thus carry it out of the pipeline.

The location of flow passageways 30 is important. By providing, in the illustrated arrangement, passageways to eiter side of each of the brush members 22 any debris which is dislodged by the passage of the brush is quickly encountered by the moving fluid flow stream within the passageways to move it to beyond the forward end 16 of the cleaning pig.

The invention thus provides an improved cleaning pig for use in pipelines, the pig having improved means of flushing debris out of the pipeline.

The claims and the specification describe the invention and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A cleaning pig for use in a pipeline to be moved through a pipeline by the flow of fluid therethrough comprising:

a cylindrical pig body of external diameter slightly greater than the internal diameter of the pipeline for which the pig is dimensioned, the pig body having a forward end and a rearward end;

a plurality of spaced apart shallow depth channels formed in said pig body cylindrical surface, each channel being in a spiral pattern, each channel extending from adjacent said forward end of said pig body to adjacent said rearward end; and an elongated narrow brush member positioned in each of said channels, each brush member having bristles which extend generally radially outwardly from said pig body and to a diameter greater than said pig body cylindrical surface, the width of said brush members being less than the width of said channels providing at least one fluid flow passageway within each of said channels.

2. A cleaning pig according to claim 1 wherein said brush member is centrally positioned in each of said channels to provide two flow passageways in each of said channels, one to either side of said brush member.

3. A cleaning pig according to claim 1 wherein said pig body is tapered to a reduced diameter portion at said forward end, and wherein said channels and said brush members extend into the tapered portion.

4. A cleaning pig according to claim 1 wherein said pig body is of semi-rigid material.

5. A cleaning pig according to claim 4 wherein said semi-rigid material is polyurethane foam material.

6. A cleaning pig according to claim 1 wherein said pig body rearward end is concave.

7. A cleaning pig according to claim 1 wherein said brush members are formed of strips of flexible backing having upstanding wire bristles extending therefrom, the flexible backing being of width less than the width of said channels.

8. A cleaning pig according to claim 7 wherein strips of flexible backing are secured to said pig body within said channels by adhesive bonding.

9. A cleaning pig according to claim 1 where there are N said channels in spaced apart spiral format, each channel covering a segment of the pig body external cylindrical surface through an arc of more than 360°/N whereby as the pig moves through a pipeline the entire internal cylindrical surface is contacted by said bristles of said brush members.

* * * * *